United States Patent [19]

Luke

[11] Patent Number: 4,677,996

[45] Date of Patent: Jul. 7, 1987

[54] SMOKING ARTICLE MOUTHPIECES

[75] Inventor: John A. Luke, Eastleigh, United Kingdom

[73] Assignee: Brown & Williamson Tobacco Corporation, Louisville, Ky.

[21] Appl. No.: 746,803

[22] Filed: Jun. 20, 1985

[30] Foreign Application Priority Data

Jun. 22, 1984 [GB] United Kingdom ..... 8415973

[51] Int. Cl.[4] ..... A24D 3/02; A24D 3/04

[52] U.S. Cl. ..... 131/336; 131/340; 131/361; 493/43

[58] Field of Search ..... 131/94, 336, 340, 341, 131/343, 344, 361; 493/42, 43, 45, 46

[56] References Cited

U.S. PATENT DOCUMENTS

| | | | |
|---|---|---|---|
| 2,958,328 | 11/1960 | Bartolomeo | 131/336 |
| 3,045,680 | 7/1962 | Smith | 131/336 |
| 3,124,143 | 3/1964 | Bartolomeo | 131/336 |
| 3,389,705 | 6/1968 | Levavi | 131/340 |
| 3,678,941 | 7/1972 | Dixon | 131/340 |
| 4,149,546 | 4/1979 | Luke et al. | 131/94 |
| 4,273,141 | 6/1981 | Jan Van Tilburg | 131/340 |
| 4,366,826 | 1/1983 | Horsewell | 131/341 |
| 4,388,934 | 6/1983 | Luke | 131/340 |
| 4,506,683 | 3/1985 | Cantrell et al. | 131/336 |
| 4,525,161 | 6/1985 | Luke | 131/341 |

*Primary Examiner*—V. Millin
*Assistant Examiner*—H. Macey
*Attorney, Agent, or Firm*—Charles G. Lamb

[57] ABSTRACT

A cigarette filter element comprising at least one duct extending from one end to the other of the element, which element is operated on by a heated former moving relatively to it in a rotary fashion. The heated former serves to provide a cavity or annular groove through filtration material of the element. The cavity or groove also extends through a section of the duct to provide a ventilation channel. The duct at least one may be of a smoke-impermeable nature and may be provided by one or more bores or thermoplastic tubes.

7 Claims, 8 Drawing Figures

SMOKING ARTICLE MOUTHPIECES

This invention relates to a method of making smoking article mouthpieces each of which comprises a tube extending therethrough, the interior of the tube being in air-flow communication with the outer peripheral surface of the element.

The present invention provides a method of making a mouthpiece element which element comprises duct means extending from one end to the other of said element, wherein said duct means and a heated former are moved relatively of each other whereby the former is caused to pass through the wall of said duct means to provide a ventilation air access to the interior of said duct means.

The duct means may be spaced from the outer surface of the element, in which case the duct means is advantageously surrounded by a matarix material extending to the outer surface of the element. Suitably, each matrix material may be a tobacco smoke filltration material. Alternatively, the matrix material may be, for example, a closed cell foam material, in which case further duct means must be provided for the passage of smoke through the element.

The duct means may be a tube or two or more similar tubes each of which extends from one end to the other of the element and each of which has a portion of its wall removed by the action of the heated former. The heated former in its movement relative of the or each of the tubes may pass through the or each tube from one side to the other, thus to effect a removal of a section of the length of the or of each tube.

The or each of the tubes providing the duct means should be formed of a thermoplastic material susceptible to remval by melting under action of the heated former. Similarly, if the duct means is surrounded by a matrix material, this too should be of a thermoplastic character, so that the heated fromer may pass through the matrix material in the path of travel of the former into contact with the duct means. Suitably, passage of the former through a thermoplastic matrix material effects a thermal sealing of the walls of the cavity produced in the matrix material by the former.

Instead of the duct means being provided as a tube(s) there may be provided a bore(s) extending through a matrix material and having substantially smoke impervious walls.

The relative movement of the heated former and the mouthpiece element is suitably rotary about the longitudinal axis of the element. In such case, should a matrix material extend from the duct means to the outer surface of the element, an annular groove will be thermally formed in the matrix material.

One or other side face of the heated former, closer to the one end or the other end of the mouthpiece element, may slope outwardly from that face of the former which is advanced furthest into the element. By way of this simple expedient, it may be arranged that the former effects closure of the duct means by a thermal welding together of the walls thereof.

The mouthpiece element may with advantage comprise an outer wrapper comprising a content of thermoplastic material, such as, for example, polyethylene or polypropylene.

Conveniently, the heated former is brought into contact with the mouthpiece element when the mouthpiece element forms part of a rod of a length a multiple, six for example, of a mouthpiece unit length.

The mouthpiece element may take the form of a filter element.

A convenient mode of production of filter rod for use in a mouthpiece element making method according to the present invention is to feed to the garniture of a filter rod making machine continuous webs of plugwrap paper and filter tow and continuous or long lengths of tubing so that there issues from the garniture a continuous rod of wrapped two with a tube(s) extending continuously therethrough.

Rod lengths may be fed, for operation thereon in accordance with the present invention, to apparatus generally constructed and operative as described and illustrated in United Kingdom Patent Specification No. 1,507,765, to which specific reference is made.

Mouthpiece elements made in accordance with the present inventive method may be incorporated in cigarettes, or other smoking articles, by attachment by a tipping wrapper to a smoking material rod. The tipping wrapper is air impermeable except for a ring of ventilation perforations overlying the part of the mouthpiece operated upon by the heated former. Hence it is possible for ventilating air to pass through the tipping wrapper and thence into the interior of the duct means.

In order that the present invention may be clearly understood and readily carried into effect, reference will now be made, by way of example, to the accompanying diagrammatic drawing, in which.

Figure 1:
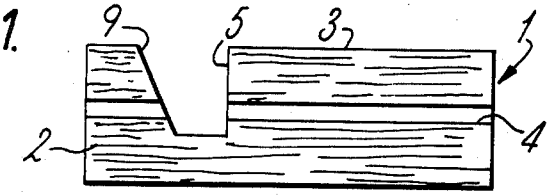
FIG. 1 shows, in axial section, a cigarette filter element.
Figure 2:
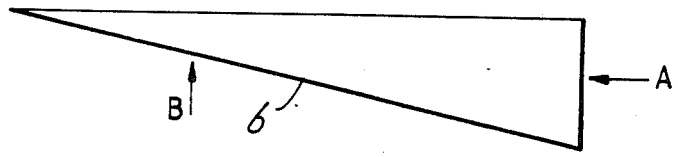
FIG. 2 shows a side elevation of a former.
Figure 3:
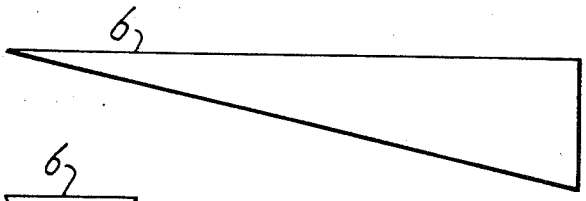
FIG. 3 shows a plan view of the former of FIG. 2.

The cigarette filter element of FIG. 1, generally designated 1, comprises a body 2 of bonded, fibrous cellulose acetate, providing a matrix material, wrapped in a plugwrap 3 which contains a proportion of synthetic thermoplastic fibres. Axially disposed of the element 1, and initially extending continuously from end to end of the element, is a plastics tube 4. The element 1 further comprises a groove-form cavity 5 which in the axial section of the element 1 shown in FIG. 1 can be seen to extend from the periphery of the element 1 radially inwardly through the body 2 of cellulose acetate to a location to the far side of the tube 4, thus to bisect the tube 4.

The groove-form cavity 5 is thermally formed by use of a heated former. A metal former 6 designed for this purpose is shown in FIGS. 2 to 5. At one, rearward end, see FIG. 4, the former 6 is of a section corresponding to that of the cavity 5 as viewing FIG. 1. As may be seen from FIGS. 2, 3 and 5, the former 6 tapers towards the other, forward end. In use of the former 6 it is, while being maintained at an elevated temperature, advanced along a linear path perpendicular to the axial plane of the element 1 which is depicted in FIG. 1. The temperature of the former is such as to melt the plugwrap 3, the cellulose acetate 2, and the tube 4, thus as the former 6 is advanced in contact with the element 1, a groove of increasing depth and width is formed in the element 1, the final conformation of the groove being in accordance with the section of the former at the downstream end thereof.

The passage of the heated former 6 through the cellulose acetate 2 has the effect that the walls of the cavity 5, including the base wall, are thermally sealed.

Figure 4:
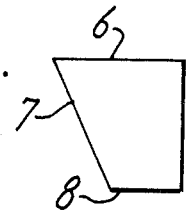
FIG. 4 shows an end view, looking in the direction of arrow A, of the former of FIG. 2.
Figure 5:
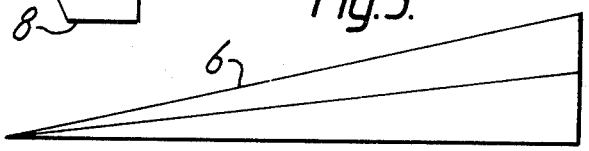
FIG. 5 shows a view of the former of FIG. 2 looking in the direction of arrow B.

As may be observed from FIG. 4, one side face, designated 7, of the former 6 slopes outwardly in a direction away from under face 8 of the former 6. Thus one side wall, designated 9, of the cavity 5 slopes in conformity with the side face 7 of the former 6. An effect of providing the former 6 with a sloping side face 7 has been found to be that the portion of the tube 4 coming into contact with the side face 7 is closed by a welding together of the walls thereof.

In use of the filter element 1, it may be attached in known manner to a tobacco rod (not shown), disposed at the left-hand end, as viewing FIG. 1, of the element 1 by means of a tipping wrapper (not shown) which is air impermeable except for a ring or zone of ventilation perforations overlying that portion of the element 1 in which is formed the cavity 5. Thus ventilation air can enter the cavity 5 through the perforations and flow from the cavity 5 through the length of the tube 4 extending rightwardly from the cavity 5. Air cannot, of course, flow through the length of the tube 4 extending leftwardly from the cavity 5 because the end of that portion of the tube 4 at the sloping wall 9 of the cavity 5 is closed.

Figure 6:
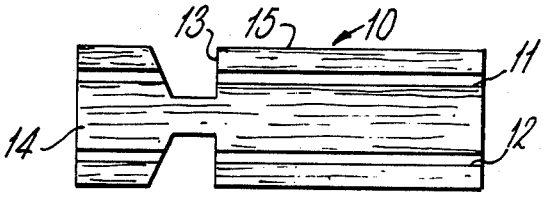
FIG. 6 shows, in axial section, a cigarette filter element of a form which is a modification of that of FIG. 1.

The cigarette filter element shown in axial section in FIG. 6 and generally designated 10 is similar to that of FIG. 1 but comprises two tubes 11 and 12, as opposed to a single tube, and a cavity provided by a continuous annular groove 13 which bisects both of the tubes 11, 12. The tubes 11, 12 are surrounded by a body 14 of bonded, fibrous cellulose acetate wrapped in a plugwrap 15 which contains a proportion of synthetic thermoplastic fibres.

The annular groove 13 may be formed in the filter element 10 by revolving the element 10, suitably before it is severed from a multiple unit length rod, in contact with a striaght or an arcuate heated former. If the former is of arcuate conformation, the rods are suitably supported between pairs of rollers of a series of rollers rotatably mounted at the periphery of a rotary drum. Apparatus of this type is disclosed in GB No. 1,507,765 to which reference should be made for a detailed understanding.

As with the filter element of FIG. 1, the former used to form the cavity groove 13 is provided with a sloping side face, as is clearly apparent from the section of the groove 13 shown in FIG. 6. The thus provided sloping face of the former effects closure of the righthand ends of those portions of the tubes 11, 12 which extend leftwardly of the groove 13. The passage of the former through the cellulose acetate 14 effects thermally a sealing of the walls of the groove 13.

The filter element of FIG. 6 may be used in a cigarette in a manner similar to the element of FIG. 1.

Figure 7:
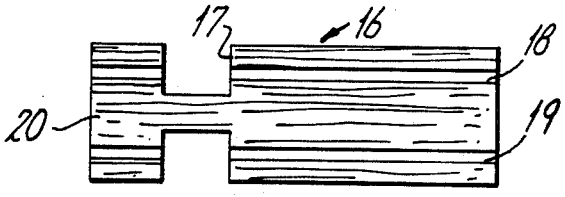
FIG. 7 shows, in axial section, a cigarette filter element of a form which is a modification of that of FIG. 6.

The filter element of FIG. 7, generally designated 16, is similar in form and may be made in a similar manner to the filter element of FIG. 1. A difference is that the former used in forming an annular groove 17 has two parallel, non-sloping side faces and thus both side walls of the groove 17 are substantially perpendicular to the longitudnal axis of the element. For this reason, the heated former does not effect closure of either the leftwardly or rightwardly extending portions of tubes 18 and 19 which are bisected by the groove 17. The heated former does though effect a sealing of the walls of the groove 17 by acting thermally on a body 20 of fibrous cellulose acetate in which the groove 17 extends.

Figure 8:
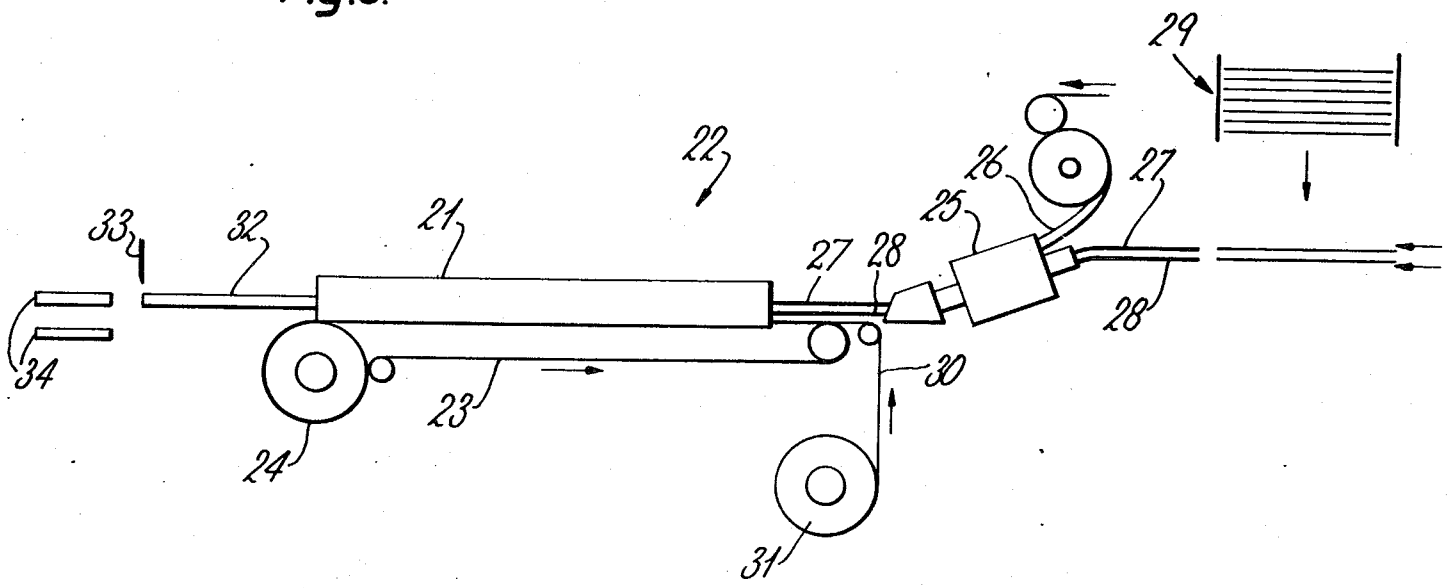
FIG. 8 shows apparatus for making filter rod lengths each comprising two tubes.

The apparatus diagrammatically shown in FIG. 8 is illustrative of apparatus operative to make filter rod through which two plastic tubes extend continuously. Such rod, after having been cut into convenient lengths is suitable for use in the method according to the present invention.

In FIG. 8 reference numeral 21 designates a rod making garniture of a filter rod making machine generally designated 22. An upper run of a garniture tape 23 passes through the garniture 21 and is driven by a pulley 24 about which the tape 23 is trained. Near to the inlet end of the garniture 21 is disposed a funnel 25 which is arranged to receive a continuous tow 26 of bloomed and plasticized cellulose acetate fibres and to direct the tow 26 forwards to the garniture 21. Extending through the funnel 25 are two rigid metal guide tubes 27 and 28, downsteam ends of which are disposed within an entry end portion of the garniture 21. Lengths of plastics tubing are fed from a magazine 29 to the upstream end of the guide tubes 27, 28 in such manner that tubing passes continuously from the downstream end of the tubes 27, 28 and into the garniture 21 during the rod making process. Within the garniture 21 the tubing is enclosed in the cellulose acetate tow 26, which in turn is wrapped in plugwrap fed to the garniture 21 as a continuous web 30 from a reel 31.

The continuous rod, designated 32, which issues from the outlet end of the garniture 21 is cut, by means of a blade indicated at 33, into discrete rod lengths 34. Each rod length 34 comprises two spaced-apart, parallel, plastics tubes enclosed in a matrix of cellulose acetate fibres.

Although in the above descriptions with reference to FIGS. 1, 6, 7 and 8 mention has been made of fibrous cellulose acetate as a matrix material, it will be readily appreciated by those skilled in the art that alternative materials, fibrous polypropylene for example, could be employed. It will also be readily understood that the form of the matrix material may be other than fibrous. Thus, for example, a matrix material may be provided which is in the form of an open or closed cell rigid foam. If the matrix takes the form of a rigid foam, bores extending therethrough may be provided instead of tubes. If a closed cell foam is employed, it will be necessary to provide a further bore(s), or a tube(s), for the passage of tobacco smoke through the filter element.

I claim:

1. A method for making a mouthpiece element, comprising the steps of: forming a cylindrical mouthpiece element; forming at least one duct means extending from one end to the other end of said cylindrical mouthpiece element and open throughout its length; forming ventilation air access means composing the step of moving said cylindrical mouthpiece element and a heated groove former relatively of each other, such that the heated groove formed is caused to penetrate the mouthpiece element to a depth sufficient to pass through said duct means thereby thermally severing the duct means forming a groove in the mouthpiece element open to the peripheral surface of the mouthpiece element and thermally sealing the groove walls of the mouthpiece element making said walls gas impervious.

2. The method as claimed in claim 1, wherein said cylindrical mouthpiece element is fabricated of a closed cell foam material.

3. A method as claimed in claim 2, wherein smoke passage means is provided for passage of smoke through said element.

4. The method as claimed in claim 1, wherein the step of forming said duct means comprises positioning a tube within said cylindrical mouthpiece element.

5. The method of claim 1, wherein the step of moving said cylindrical mouthpiece element and a heated groove former relative to each other closes one end of the severed duct means in the groove.

6. The method as claimed in claim 1 wherein said relative movement of said heated former is rotary about the longitudinal axis of said mouthpiece element.

7. The method as claimed in claim 1, wherein said cylindrical mouthpiece element is comprised of thermoplastic material.

* * * * *